US009422680B2

(12) United States Patent
Furlanetto

(10) Patent No.: US 9,422,680 B2
(45) Date of Patent: Aug. 23, 2016

(54) DECK

(71) Applicant: Guido Furlanetto, Codogne' (IT)

(72) Inventor: Guido Furlanetto, Codogne' (IT)

( * ) Notice: Subject to any disclaimer, the term of this patent is extended or adjusted under 35 U.S.C. 154(b) by 0 days.

(21) Appl. No.: 14/679,336

(22) Filed: Apr. 6, 2015

(65) Prior Publication Data

US 2015/0292168 A1 Oct. 15, 2015

(30) Foreign Application Priority Data

Apr. 14, 2014 (IT) ..... MI2014A0691

(51) Int. Cl.

| | |
|---|---|
| ***E01D 2/00*** | (2006.01) |
| ***E01D 6/00*** | (2006.01) |
| ***E01D 19/00*** | (2006.01) |
| *E01D 101/30* | (2006.01) |
| *E01D 101/24* | (2006.01) |
| *E01D 101/26* | (2006.01) |

(52) U.S. Cl.
CPC . *E01D 6/00* (2013.01); *E01D 2/00* (2013.01); *E01D 19/00* (2013.01); *E01D 2101/24* (2013.01); *E01D 2101/268* (2013.01); *E01D 2101/30* (2013.01)

(58) Field of Classification Search
CPC ..... E01D 2/00; E01D 6/00; E01D 19/00
USPC ..... 14/4, 13, 73, 74.5
See application file for complete search history.

(56) References Cited

U.S. PATENT DOCUMENTS 354,558 A * 12/1886 Latimer ..... E01B 25/305 104/124
3,103,025 A * 9/1963 Gassner ..... E01D 2/00 14/6
3,111,207 A * 11/1963 Braddon ..... E04C 3/09 138/156
3,257,764 A * 6/1966 Cripe ..... E01D 2/04 14/74.5
3,872,532 A * 3/1975 Cornelius ..... E01D 2/04 14/3
3,893,276 A * 7/1975 Brown ..... E04B 9/00 257/E29.065
4,282,619 A * 8/1981 Rooney ..... E01D 2/04 14/6
4,349,996 A * 9/1982 Lautensleger ..... E04B 7/00 403/230
4,481,899 A * 11/1984 Einstabland ..... B63B 35/50 114/258
4,741,063 A * 5/1988 Diana ..... E01D 11/02 14/18
4,912,794 A * 4/1990 Thivans ..... E01D 2/02 14/3
4,993,094 A 2/1991 Muller
2011/0196561 A1* 8/2011 Jorgensen ..... B60L 5/38 701/23

FOREIGN PATENT DOCUMENTS

SG 189118 A1 5/2013
WO 2012/044013 A2 4/2012

OTHER PUBLICATIONS

The Italian Search Report for Italian Application No. MI20140691; two pages; competed Dec. 4, 2014.

* cited by examiner

*Primary Examiner* — Gary Hartmann
(74) *Attorney, Agent, or Firm* — Vorys, Sater, Seymour & Pease LLP

(57) ABSTRACT

Provided is a deck, configured for supporting a carriageable surface, including first structural girders defining a support surface for the carriageable surface; at least one second structural girder configured to position itself on the opposite side to said carriageable surface in relation to the first structural girders; diagonal girders integrally connecting the first and said second structural girders to each other, defining, for the deck, a truss; said first and said second structural girders include a core in concrete material: and an external reinforcement partially cladding the core and made of metallic material.

12 Claims, 2 Drawing Sheets

DECK

TECHNICAL BACKGROUND OF THE INVENTION

The present invention relates to a deck suitable for supporting a carriageable surface and comprising first structural girders defining a support surface for the carriageable surface; at least a second structural girder suitable to position itself on the opposite side to the carriageable surface in relation to the first structural girders; diagonal girders integrally connecting the structural girders to each other, defining, for the deck, a truss; the deck defining a support surface. In particular, the invention relates to a structure suitable to define a substantially horizontal plane on which to make the carriageable surface and used for the construction of bridges.

DESCRIPTION OF THE PRIOR ART

As known, bridges are used to overcome an obstacle, such as a watercourse or a valley, which prevents the continuity of a communication route such as a road or a railway network.

These consist of a carriageable surface suitable to connect portions of the communication route separated by said obstacle; one or more decks suitable to define the support structure on which to make the carriageable surface: and pylons, abutments or other similar structural elements designed to sustain the deck and thus the carriageable surface suspended over the obstacle.

One of the most important structures is the deck which consists of a single body made of concrete/reinforced concrete and a having a flat upper surface on which to build the carriageable surface and a cross-section of maximum width at the end and minimum width in the centre so as to define a substantially arc-shaped profile for the deck.

Alternatively, the deck has a slab in reinforced concrete defining said flat upper surface and a steel skeleton suitable to absorb the weight of the deck and the loads acting on it.

The prior art mentioned above has several significant drawbacks.

A first significant drawback is the difficulty of transporting and installing the deck.

This problem is caused by the fact that the decks, on account of the complexity of construction, are made in special factories and must therefore be transported on site arranging expensive and challenging oversized transport.

This problem is further increased by the fact that once brought on-site the decks, having to be lifted and placed on pylons and abutments, require special and expensive lifting means.

This drawback is particularly relevant in the case of reinforced concrete decks where the high density of said reinforced concrete makes it even more complex and difficult to transport and install.

Another drawback is that the decks, especially when made of reinforced concrete, are subject to deterioration from exposure to the elements, to structural movements or exceptional events such as earthquakes.

The deterioration factor is further increased by the action of oxygen leading to the formation of rust on the iron reinforcement of the concrete.

The formation of rust also causes an increase in volume in the iron reinforcement giving rise to blistering and flaking of the concrete, which interrupts the structural continuity thereof reducing its mechanical strength.

In this situation the technical purpose of the present invention is to devise a deck able to substantially overcome the drawbacks mentioned above.

Within the sphere of said technical purpose one important aim of the invention is make a deck which is easy to transport and install.

Another important purpose of the invention is to make a deck practically immune to deterioration phenomena and thus characterised by high reliability and durability.

SUMMARY OF THE INVENTION

The technical purpose and specified aims are achieved by a deck suitable for supporting a carriageable surface and comprising first structural girders defining a support surface for the carriageable surface; at least a second structural girder suitable to position itself on the opposite side to the carriageable surface in relation to the first structural girders; diagonal girders integrally connecting the structural girders to each other, defining, for the deck, a truss; the deck defining a support surface; wherein the structural girders comprise a core in concrete material, an external reinforcement partially cladding the core leaving a portion of the core visible, connection means between portions of the first structural girders and the projecting diagonal girders comprising connection elements projecting from the support surface.

BRIEF DESCRIPTION OF THE DRAWINGS

The characteristics and advantages of the invention are clearly evident from the following detailed description of a preferred embodiment thereof, with reference to the accompanying drawings, in which.

DESCRIPTION OF THE PREFERRED EMBODIMENTS

Figure 1:
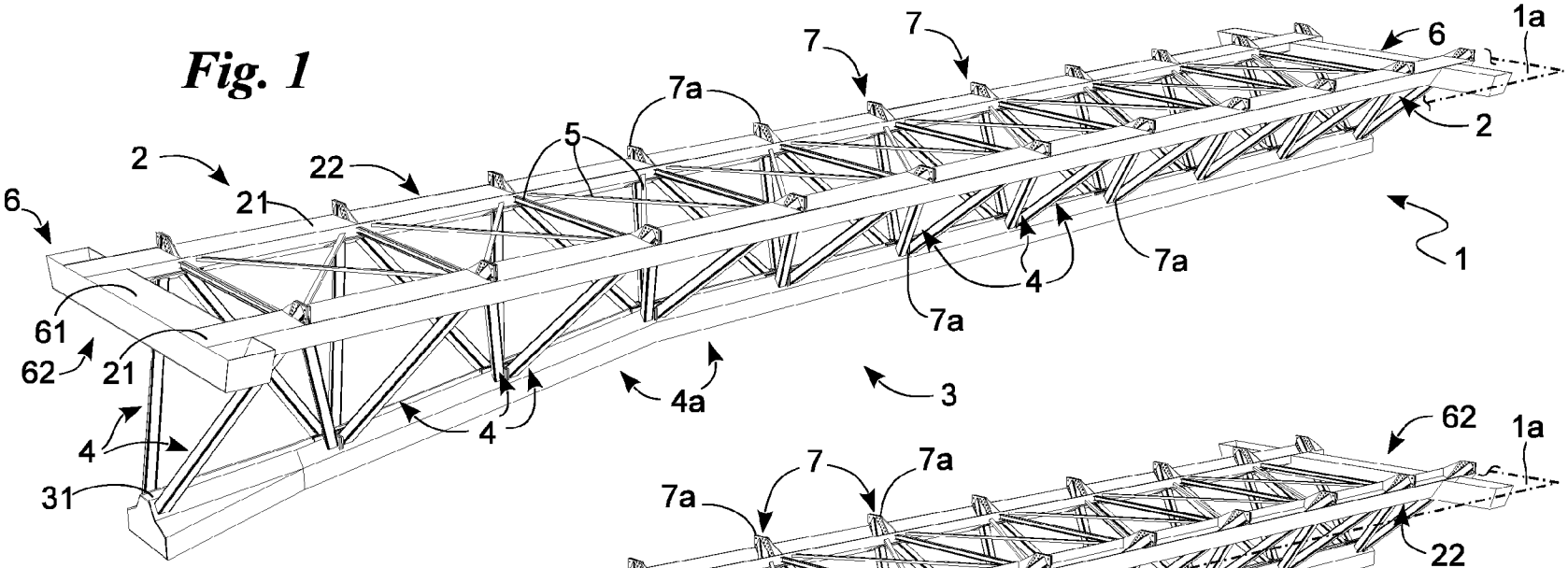
FIG. 1 shows the deck according to the invention.

With reference to said drawings, reference numeral 1 globally denotes the deck according to the invention.

It is suitable to be used to support a carriageable surface such as a road or a railway network and thus to make a bridge, preferably, a bridge or deck with substantially continuous girders and at a variable height, and more preferably, a deck arch bridge.

The bridge includes a carriageable surface, one or more decks 1 suitable to support the carriageable surface and defining a support surface 1*a*, preferably substantially flat and support structures comprising pylons, abutment and other similar elements positioned at the ends of each deck so as to keep said deck 1 raised from the ground.

The deck 1 comprises first structural girders 2 defining a support surface, preferably practically flat, for the carriageable surface; at least one second structural girder 3 suitable to position itself on the opposite side to said carriageable surface in relation to the first structural girders 2; and diagonal girders 4 integrally connecting the structural girders 2, 3 to each other, defining, for the deck 1, a truss and connection means 7 between the structural girders 2 and/or 3 to each other and/or to the diagonal girders 4, suitable to integrally connect said elements to each other by means of screws and bolts, welding, or otherwise.

In detail, the deck 1 comprises two first structural girders 2 and one second structural girder 3 substantially equally spaced from the first structural girders 2.

Each of the structural girders 2 and 3, as described below, has a core in concrete material and an external reinforcement made of metal material and partially cladding the core so as to leave a portion thereof visible.

The cores of the structural girders 2 and 3, just as their external reinforcements are made of the same material. In particular, they are in self-compacting concrete which, thanks to a high degree of fluidity, is able to fill the formwork merely by effect of its weight and, therefore, without external energy input or mechanical vibration.

The external reinforcements are open sections, preferably made by press-forming, and in steel, to be precise, in weathering steel and, more precisely, in Cor-Ten Steel®.

The first structural girders 2 preferably have an equal cross-section, are specular and comprise a first core 21 and a first external reinforcement 22.

The first external reinforcement 22 is a section, with a constant cross-section, open at the top, i.e. with the opening at the top so that the concrete material of the core 21 is cast inside by gravity. It has a thickness comprised between about 1 and 3 cm and, more specifically, practically equal to 1.6 cm.

It is preferably a substantially U-shaped section defining an inner lateral side 221 facing the other first girder 2 and vertical, i.e. substantially parallel to the gravitational gradient; an external lateral side 222, inclined, preferably by 30°-60° with respect to the inner side 221; at least one slab 223 substantially perpendicular to the sides 221 and 222 to which the diagonal girders 4 are connected; and one bottom side 224 connecting the lateral sides 221 and 222 and practically perpendicular to the external lateral side 222. Said slab 223 forms part of the connection means 7 between the structural girders 2 and/or 3 to each other and/or with the diagonal girders 4.

The first external reinforcement 22 is, at the ends, devoid of partitions so as to allow the concrete material cast into it and constituting the core 21 to spill outside the external reinforcement 22.

The second structural girder 3 comprises a second core 31 and a second external reinforcement 32. These are preferably made by the press-forming of steel plates. They are also, preferably, filled with self-compacting concrete (SCC).

The second external 32 reinforcement comprises a hollow body 321 open at the top comprising partitions 322 closing the ends so as to prevent the concrete material cast inside it from spilling; and, arranged inside the section, a lamina 323 extending over the entire length of the exterior reinforcement 32 and welded to the base of the section.

Said hollow body 321 has a practically pentagonal cross-section with a horizontal base, i.e. practically perpendicular to the gravitational gradient, and an opening made at the vertex opposite the base so that the concrete material of the core 31 can be cast inside it by gravity.

The hollow body 321, the partitions 322 and the lamina 323 have a thickness at least equal to the first external reinforcement 21. In detail, substantially between 100% and 150%, and preferably substantially equal to 125% of the thickness of the first formwork 21. Said thickness of the second formwork 32 is practically comprised between 1.5 and 4 cm and, in particular, practically equal to 2 cm.

The second external reinforcement 32 and, therefore, the second girder 3 have a first tapered portion 3*a* with its maximum cross-section at the ends of the deck 1; and a second portion 3*b* with a constant cross-section equal to that the minimum cross-section of the first portion. Alternatively, the second girder 3 has two first portions 3*a* and one second portion 3*b* interposed between the portions 3*a*.

The diagonal girders 4 integrally connect the structural girders 2 and 3 so as to define, for the deck 1, a truss, appropriately, a substantially triangular truss.

The diagonal girders 4 (FIG. 5) define a truss comprising adjacent pyramidal architectures 4*a*, appropriately with a square base, integral with one another and having the vertexes of the base and apexes integral with respect to the first girders 2 and to the second girder 3.

In particular, they are at least partially housed in the external reinforcements 22 and 23 and protrude from them through respective first openings 22*a* and second openings 32*a* of the external reinforcement 32 counter-shaped to the diagonal girders 4. More specifically, the diagonal girders 4 have one end integral with the formworks 22 and protruding from them so as to be embedded in the concrete material constituting the carriageable surface.

Each diagonal girder comprises a section 41; and a first plate 42 and a second plate 43 integrally connected, preferably by welding, and more preferably by full penetration welding, at the ends of the section 41 closing the ends, and respectively, to the first external reinforcement 22 and the second external reinforcement 32.

The section 41 is identifiable in a section open at the top, appropriately with a U shape, having a thickness between 1 and 3 cm and, more precisely, practically equal to 1.6 cm.

The first plate 42 is a flat plate made integral with the slab 223 by bolts and to another first plate 43 so as to enclose the slab 223 between two first plates 42.

Said plates 42 and 43 thus form another part of the connection means 7.

Advantageously, the connection means 7 comprise connection elements 7*a*, not parallel, and preferably perpendicular to the main direction of extension of the deck 1, composed in particular of the plates 42, 43 and the slab 223, projecting from the support plane 1*a*, and possibly also from the surface of the second structural girders 3, and suitable to create a support for external elements.

Each second plate 43 is an L-shaped plate made integral, preferably by bolting on one side to the panel 323 and on the other to another second plate 43 so that four diagonal girders 4 are connected to the same portion of panel 223 forming the apex of a pyramidal architecture 4*a*.

The plates 42 and 43 have a thickness substantially comprised between 1.5 cm and 4 cm and preferably substantially equal to 3 cm.

The section 41 and the plates 42 and 43 are made of the same material as the formworks of the external reinforcements 22 and 32. Consequently, they are made of steel and, to be precise, weathering steel and, more precisely, Cor-Ten Steel®.

Additionally, the diagonal girders 4 may provide for a third core filling the space defined by the section 41 and by the plates 42 and 43 and made of concrete material and, to be precise, in self-compacting concrete.

The deck 1 may lastly provide for stiffeners 5 of the truss and, in detail, of the pyramidal architectures 4*a* suitable to connect the vertexes of the base of each pyramidal architecture 4*a* to each other; and supports 6, preferably one for each end of the first girders 2, defining the support surfaces of the deck 1 on the support structures.

Preferably, the deck 1 has four stiffeners subtended between the internal lateral sides 221.

These are identifiable in single or double T sections connected by welding and in particular by full penetration welding to opposite first external reinforcements 22.

The supports 6 are substantially similar to the girders 2, 3 and 4 and, therefore comprise an additional core 61 in concrete material and, in detail, in self-compacting concrete; and an additional formwork 62 suitable to clad, preferably exclusively, a limited portion of the additional core 61 and made of steel and, to be precise, of weathering steel and, more precisely, Cor-Ten Steel®.

The additional external reinforcement 62 is a section open at the top, of a thickness substantially equal to that of the second external reinforcement 32. Said thickness is therefore substantially comprised between 1.5 and 4 cm and, in particular, practically equal to 2 cm.

In particular, the additional external reinforcement 62 is identifiable in a U shape open section suitable to contain, for each first girder 2, one end and having lateral sides 621 suitable to keep in the concrete material of the additional core 61 preventing it from spilling outside before hardening.

The functioning of a bridge provided with a deck, described above in a structural sense, is as follows.

In particular, such embodiment defines an innovative method of constructing a bridge comprising an assembly step in which the external reinforcements 22, 32 and diagonal girders 4 are connected to each other creating one or more trusses; a foundation step in which the pylons, abutments or other support structures for the trusses are made; a transport step in which said truss is transported close to the construction site of the bridge; a laying step in which the ends of each girder are laid and connected to the support structures; a casting step in which the concrete material is cast into the truss forming the deck 1; and a final step in which the carriageable surface is made on the deck 1.

Figure 2:
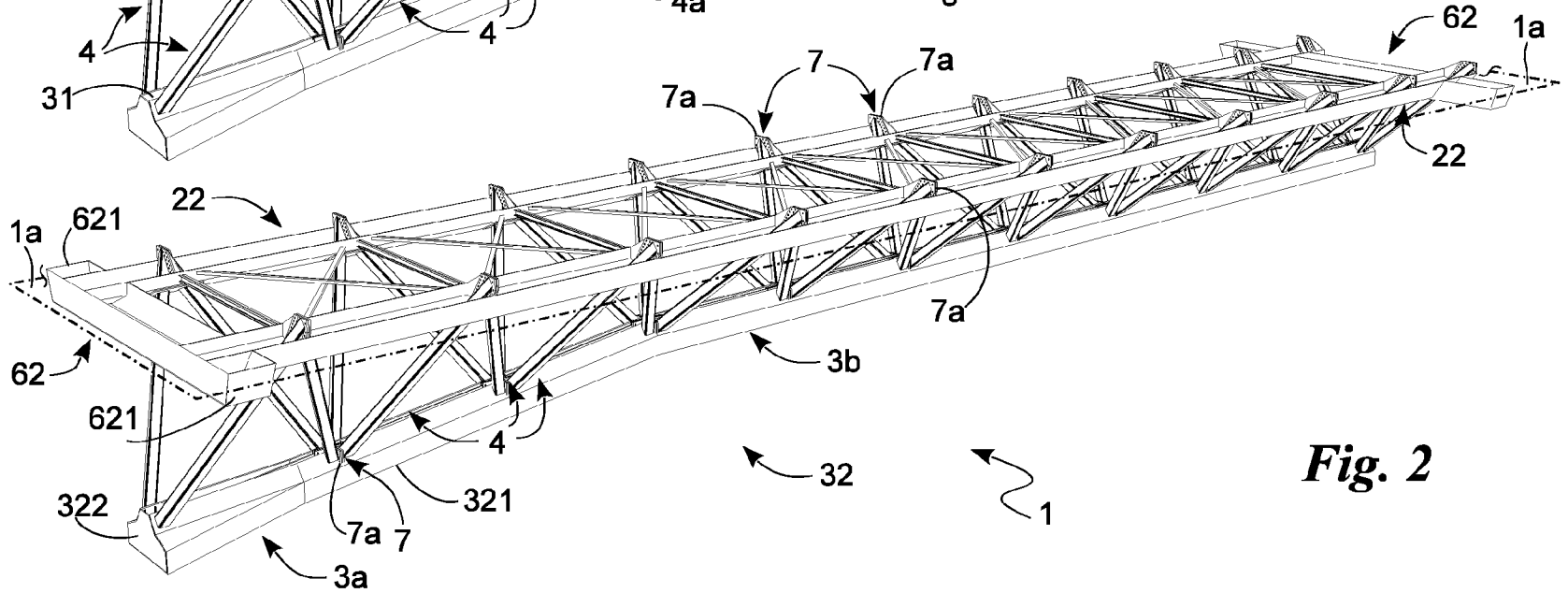
FIG. 2 shows the deck at an intermediate stage of its manufacture.
Figure 3:
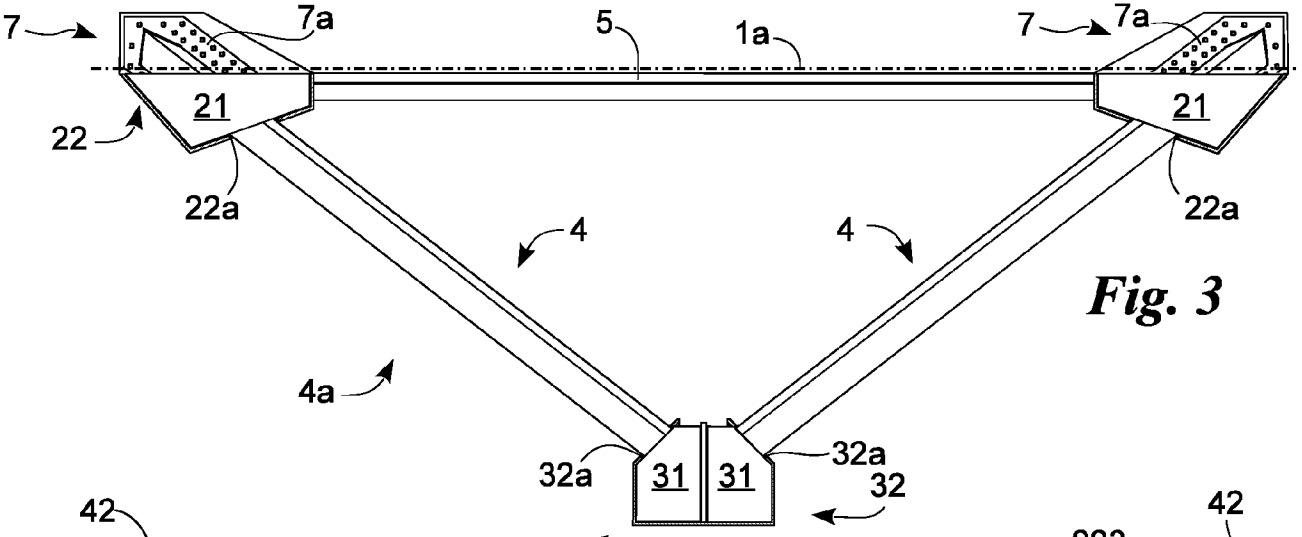
FIG. 3 shows an assembly of the deck according to the invention.
Figure 4:
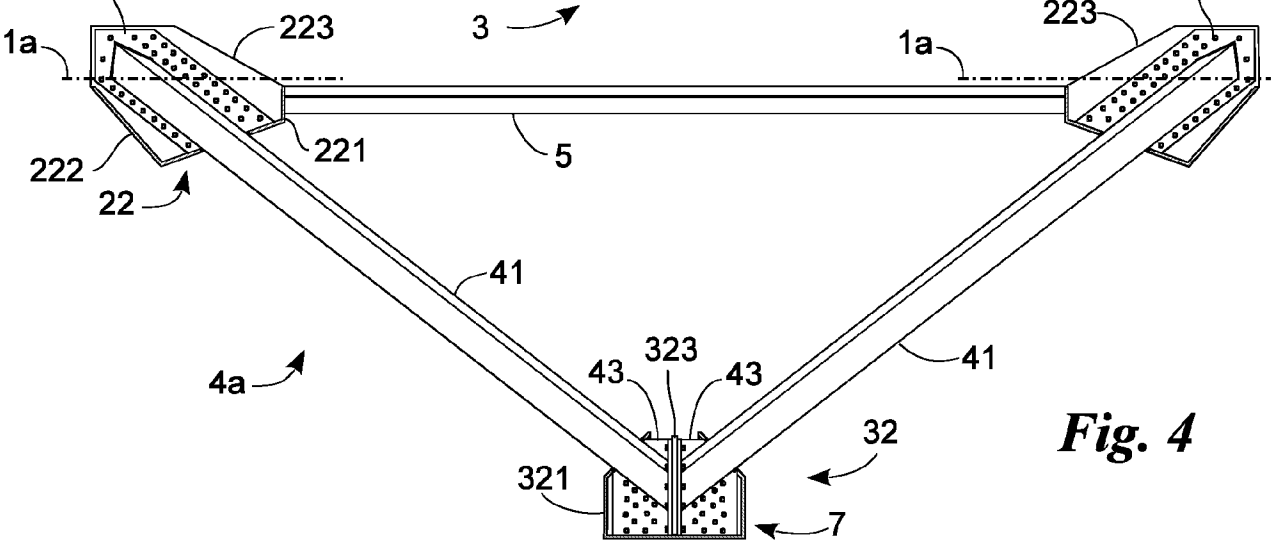
FIG. 4 shows the assembly in FIG. 3 during said intermediate stage.

In the assembly step the sections 41 are integrally connected, using the connection means 7, in particular by welding (appropriately full penetration welding), to the plates 42 and 43 forming the diagonal girders 4, which are then inserted through the openings 22*a* and 32*a* in the first external reinforcements 22 and in the second external reinforcement 32 and connected to them by bolting or full penetration welding making the pyramidal architecture 4*a* and thus a truss (FIGS. 2 and 4).

It is to be noted how, to prevent unwanted spillage of the concrete material from the openings 22*a* and 32*a*, the diagonal girders 4 and in particular the sections 41 are welded, preferably with full formwork penetration welding to the external reinforcements 22 and 32 at said openings 22*a* and 32*a*.

Lastly, this step is completed by welding, appropriately full penetration welding, stiffeners 5 to the internal lateral sides 221 and two additional formworks 62 to the ends of the first formworks 22.

After completing this assembly step the transport and laying steps are performed in which the truss, i.e. the deck 1 without concrete material, is transported and then firmly attached to the support structure.

Figure 5:
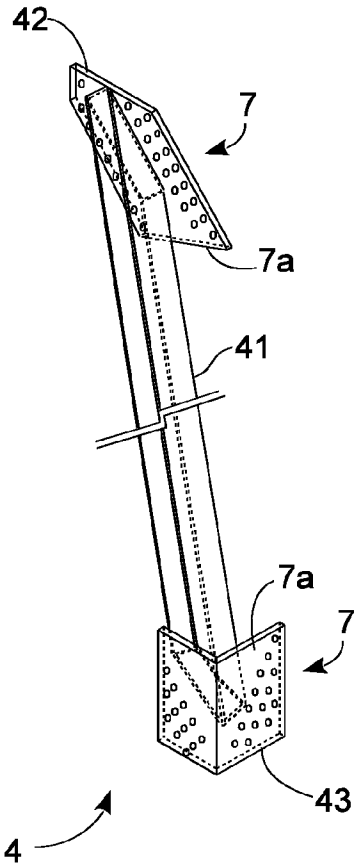
FIG. 5 shows an element of the deck according to the invention.

After completing these steps, the method provides for casting the concrete material which when solidified will constitute the cores 21, 32 and 61 (FIGS. 1 and 5).

In particular, at this step the concrete material is cast, by gravity, inside the second external reinforcement 32 and the first external reinforcements 21 from the ends of which it escapes to fill the additional external reinforcements 62. Even the diagonals 4-4*a* are appropriately filled with concrete.

Lastly, the method provides for the laying step in which the carriageable surface is made by casting concrete material onto the first structural girders 2 so as to encompass within it the ends of the diagonal girders 4 protruding from said first girders 2, also constituting the connection means 7 for upper portions of the carriageable surface 7.

The invention achieves important advantages.

A first advantage is the fact that the deck 1, by permitting the definition of an innovative method, is simple and quick to build, and, in particular, does not require plants fitted with expensive machinery.

This advantage is given by the special girders 2 and 3 and, additionally, by the stiffeners 5 which, having a core 21, 31 and 61 in concrete material and an external reinforcement 22, 32 and 62 cladding only partially said cores, makes it possible to make the core at a later time.

In fact, as may be seen from the method, such a solution makes it possible to create a truss 4*a* which being devoid of cores 21, 31 and 61, is lightweight and easy to transport.

This aspect has been further increased by the use, as concrete material, of self-compacting concrete which shrinks whatever the shape of the formworks 22, 32 and 62 by effect of its own weight and without the input of external energy or vibrations.

Another advantage is given by the conformation of the connection means 7 and connection elements 7*a*, which permits the connection of elements above the support surface 1*a*.

A further advantage, given by the use of external reinforcements 22, 32 and 62 and diagonal girders 4 in weathering steel and, more precisely, Cor-Ten Steel®, is identifiable in the high resistance to external agents, and thus, in the long duration of the deck 1. All the external reinforcements in steel sheeting are preferably made by press-forming sheets of suitable thickness. This solution makes it possible to reduce by about 50% the usual quantities of structural metalwork.

The invention is susceptible to variations within the inventive concept. All the elements as described and claimed may be replaced with equivalent elements and the details, materials, shapes and dimensions may be as desired.

The invention claimed is:

1. A deck configured for supporting a carriageable surface, comprising:

a plurality of upper structural girders defining a support surface for said carriageable surface;

at least one lower structural girder positioned on the opposite side of said carriageable surface in relation to said upper structural girders;

diagonal girders integrally connecting said upper and said lower structural girders to each other, defining a truss;

said deck defining a support surface;

said upper and said lower structural girders comprise a core of concrete material, an external reinforcement partially cladding said core leaving a portion of said core exposed, connection means between portions of said upper structural girders and said projecting diagonal girders comprising connection elements, projecting from said support surface.

2. The deck according to claim 1, wherein said connection elements are not parallel to a main direction of extension of said deck and comprise a slab integral with said external reinforcement of said upper or said lower structural girders and a first or second plate integral with said diagonal girders.

3. The deck according to claim 2, wherein said connection elements extend perpendicular to the main direction of extension of said deck.

4. The deck according to claim 1, wherein said core comprises self-compacting concrete.

5. The deck according to claim 1, wherein said external reinforcement comprises weathering steel.

6. The deck according to claim 1, further wherein said external reinforcement comprises press-formed steel sheeting.

7. The deck according to claim 1, further wherein said external reinforcement is open at the top.

8. The deck according to claim 1, wherein said upper structural girders and said lower structural girder respectively comprise a first external reinforcement and a second external reinforcement provided with openings and said diagonal girders have ends housed in said external reinforcements through said openings.

9. The deck according to claim 1, wherein two of said plurality of upper structural girders and one of said at least one lower structural girder are substantially equally distanced from said upper structural girders, and wherein said diagonal girders define a truss comprising pyramidal architectures.

10. The deck according to claim 9, wherein said pyramidal architectures have a square base.

11. A method of making a bridge comprising the deck according to claim 1, said production method comprising:

integrally connecting the first external reinforcements, at least one second external reinforcement and the diagonal girders to form at least one truss;

transporting said at least one truss to a site for building said bridge; and casting a concrete material in said first external reinforcements and in said at least one second external reinforcement to form cores of concrete material and forming said deck.

12. The production method according to claim 11, wherein said transporting occurs prior to said casting.

* * * * *